US012516919B2

(12) United States Patent
Bucher et al.

(10) Patent No.: US 12,516,919 B2
(45) Date of Patent: Jan. 6, 2026

(54) BULLET CARTRIDGE, METHOD FOR MANUFACTURING A BULLET CARTRIDGE AND PLANT FOR MANUFACTURING BULLET CARTRIDGES

(71) Applicant: RUAG Ammotec AG, Thun (CH)

(72) Inventors: Markus Bucher, Wohlen Bei Bern (CH); Michael Muster, Thun (CH); Franck Jauzion-Graverolle, Thun (CH)

(73) Assignee: RUAG Ammotec AG, Thun (CH)

( * ) Notice: Subject to any disclaimer, the term of this patent is extended or adjusted under 35 U.S.C. 154(b) by 187 days.

(21) Appl. No.: 18/264,985

(22) PCT Filed: Jan. 20, 2022

(86) PCT No.: PCT/EP2022/051247
§ 371 (c)(1),
(2) Date: Jan. 11, 2024

(87) PCT Pub. No.: WO2022/171414
PCT Pub. Date: Aug. 18, 2022

(65) Prior Publication Data

US 2024/0151504 A1 May 9, 2024

(30) Foreign Application Priority Data

Feb. 10, 2021 (DE) ..... 102021103150.8

(51) Int. Cl.
*F42B 33/00* (2006.01)
*F42B 5/067* (2006.01)

(52) U.S. Cl.
CPC ..... *F42B 33/001* (2013.01); *F42B 5/067* (2013.01)

(58) Field of Classification Search
CPC ..... F42B 33/001; F42B 5/067
See application file for complete search history.

(56) References Cited

U.S. PATENT DOCUMENTS 5,010,841 A * 4/1991 Stewart ..... B05C 5/0208 118/244
5,087,484 A * 2/1992 Stewart ..... B05C 5/0208 427/430.1

(Continued)

FOREIGN PATENT DOCUMENTS

DE 3544623 A1 7/1986
EP 0110862 B1 9/1986

(Continued)

OTHER PUBLICATIONS

Apr. 29, 2022 (PCT) International Search Report and Written Opinion—App. PCT/EP2022/051247.
Sep. 15, 2021 (DE) Office Action—App. 102021103150.8.

*Primary Examiner* — Jonathan C Weber
(74) *Attorney, Agent, or Firm* — Banner & Witcoff, Ltd.

(57) ABSTRACT

A bullet cartridge (1) may include a bullet case (3) defining a caliber diameter (D), a projectile (4) inserted into the neck portion (31) of the bullet case (3), and at least one annular layer (51, 52) of a sealing medium (5) formed from a sealing medium (5) between the bullet case (3) and the projectile (4). The bullet case (3) may be provided with the annular layer (51, 52) using a microdosing device (microdoser) (7). The annular layer may include not more than 1 mg of sealing medium (5) per mm of caliber diameter (D).

18 Claims, 1 Drawing Sheet

(56) References Cited

U.S. PATENT DOCUMENTS

Figure 2A:
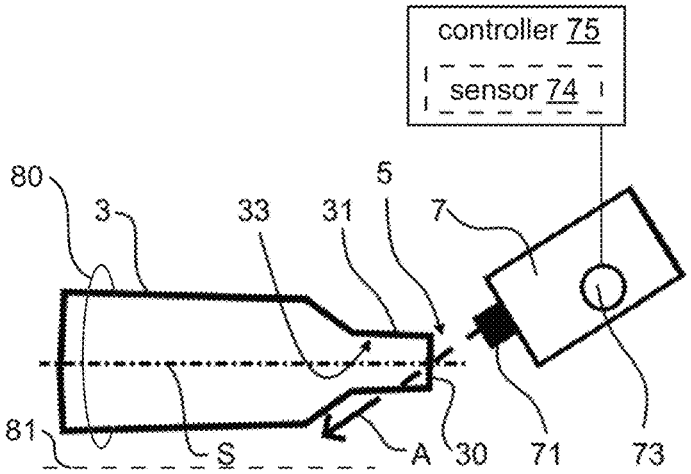

| | | | | | |
|---|---|---|---|---|---|
| 5,256,203 | A | * | 10/1993 | Moore | B05C 5/0212 118/302 |
| 6,001,181 | A | * | 12/1999 | Bullen | B05C 5/0216 118/679 |
| 2005/0056183 | A1 | | 3/2005 | Meshirer | |
| 2020/0124388 | A1 | | 4/2020 | Arnon | |

FOREIGN PATENT DOCUMENTS

| | | | |
|---|---|---|---|
| GB | 2305994 | A | 4/1997 |
| WO | 2017198328 | A1 | 11/2017 |

* cited by examiner

BULLET CARTRIDGE, METHOD FOR MANUFACTURING A BULLET CARTRIDGE AND PLANT FOR MANUFACTURING BULLET CARTRIDGES

CROSS REFERENCE TO RELATED APPLICATIONS

This patent application is a U.S. national stage application of PCT international Application No. PCT/EP2022/051247, filed Jan. 20, 2022, which claims priority to German Patent Application No. 10 2021 103 150.8, filed Feb. 10, 2021, each of which is incorporated herein by reference in its entirety.

BACKGROUND

Field

The disclosure relates to a method for manufacturing a bullet cartridge, a plant for manufacturing bullet cartridges and a bullet cartridge.

Related Art

In particular in the case of small and medium calibers, seals are required which are leak-proof over a long period of more than 10 years despite negative or positive pressure and in an intended temperature band. The sealing between the projectile and the case should be as cost-effective as possible. The seal between the projectile and the case should also ensure high pull-out resistance and be as easy as possible to manufacture in series.

Sealants with a highly viscous sealing medium are generally known from the prior art. Usually, a viscous sealing medium with a corresponding thinner is applied to the inside of the case. Joining the projectile into the case forces part of the applied sealing medium into the case. The remaining sealant then creates the seal. When the projectile is fired, the sealing medium is burned off. The connection between the projectile and the case by means of the high-viscosity sealing medium is a force-fit and a material-fit. However, a highly viscous sealing medium is very problematic to handle because of its viscosity.

WO 2017/198328 A1 relates to a bullet cartridge with a projectile and a case and with a seal between the projectile and the case, the seal being formed by two rings of a bituminous mixture. Bituminous sealants show advantageous mechanical and thermal properties in terms of long storage as well as in terms of pull-out resistance and are appreciated for their low cost. To apply the bituminous sealant, a spraying technique can be used in which a bullet case is held stationary with its opening vertically downward, and then a mirror is inserted into the confluence of the case, against which a bitumen channel is directed, from which bitumen is sprayed under pressure. Such a manufacturing plant is very complex in construction and operation. It has been found that the application of small amounts of paint below a minimum dispensing amount cannot be implemented in a reproducible manner in series production. It has also proved disadvantageous that the application of the spray technique inevitably causes contamination with bitumen, for example at the confluence and outside the bullet case, so that it requires costly cleaning.

In a so-called lubricating nose process, a sealing medium is continuously provided at an output opening. The sealing medium is wiped off along the neck of the cartridge case.

Precise process control cannot be achieved. The process requires a very high amount of sealing medium and is therefore disadvantageous for series production. A process in which a sealing medium is applied by means of a needle of the hypodermic needle type and, if necessary, a wiper is additionally used in the wake of the needle to adjust the thickness of the applied layer of sealing medium is described, for example, in US 2005 0 056 183 A1. According to US 2005 0 056 183 A1, a light-curing coating is to be applied because sealing media containing bitumen are considered unsuitable for such manufacturing processes. U.S. Pat. No. 6,367,386 B1 also criticizes the fact that automated application of bituminous sealants is not feasible.

In EP 0 110 862 B2, it is proposed to design the projectile with a circumferential groove in order to achieve a desired sealing effect with the aid of viscous bitumen coating. This process has proved uneconomical and therefore unsuitable for series production.

U.S. Pat. No. 5,256,203 A describes a plant for applying an anaerobic sealing medium to a cartridge case. For this purpose, a mandrel is inserted into the neck of the cartridge case. The mandrel has a circumferential groove on the outside in which the sealing medium is applied to the neck of the cartridge case in an annular manner. Towards the interior of the case, the circumferential groove is bounded by a fully cylindrical plate section. Five mandrels each are fed with the sealing medium through internal channels from a common metering valve. The plant is unsuitable for viscous sealing media, such as bitumen. For stable process control, a high minimum delivery amount of sealing medium per mandrel is required. As a result of the required amount of sealing medium, series production with such a plant is only economically feasible to a limited extent.

If the process is poorly controlled, for example if too high a amount of the sealing medium is applied to the case, the annular layer produced may become too thick or too wide. A ring that is too thick has the disadvantage that the case is unnecessarily widened, causing the case mouth to fall out of tolerance. A ring that is too wide has the disadvantage that the sealing effect can be impaired.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
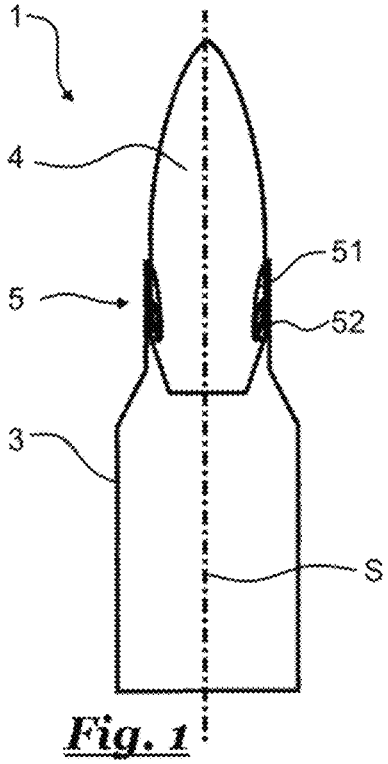

FIG. 1 a schematic sectional view of a bullet cartridge according to one or more exemplary embodiments of the disclosure.

FIG. 2*a* a schematic representation of a method in which a first annular layer of sealing medium is applied to a bullet case according to one or more exemplary embodiments of the disclosure.

Figure 2B:
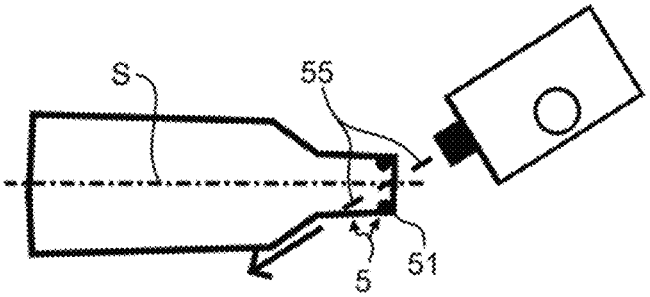

FIG. 2*b* a schematic representation of a method in which a second annular sealing medium layer is applied according to one or more exemplary embodiments of the disclosure.

Figure 3A:
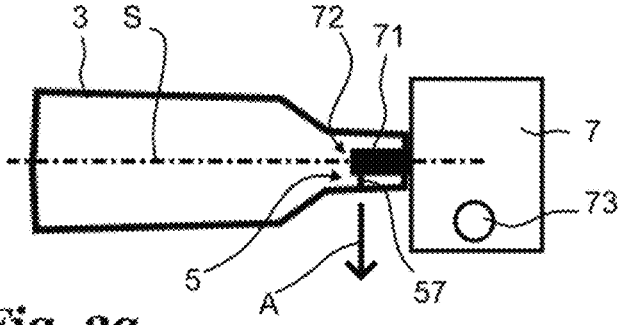

FIG. 3*a* a schematic representation of another method in which a first annular sealing-medium-layer is applied to a bullet case according to one or more exemplary embodiments of the disclosure.

Figure 3B:
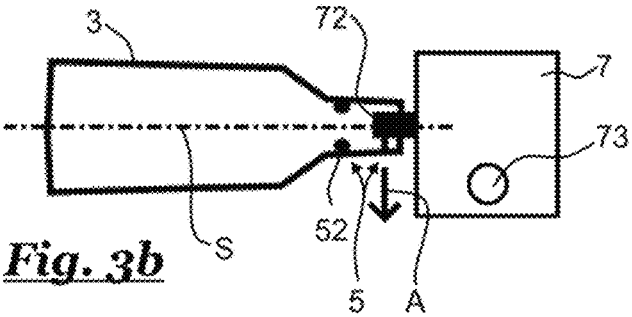

FIG. 3*b* a schematic representation of the application of a second sealing-medium-layer of the other method according to one or more exemplary embodiments of the disclosure.

Figure 4:
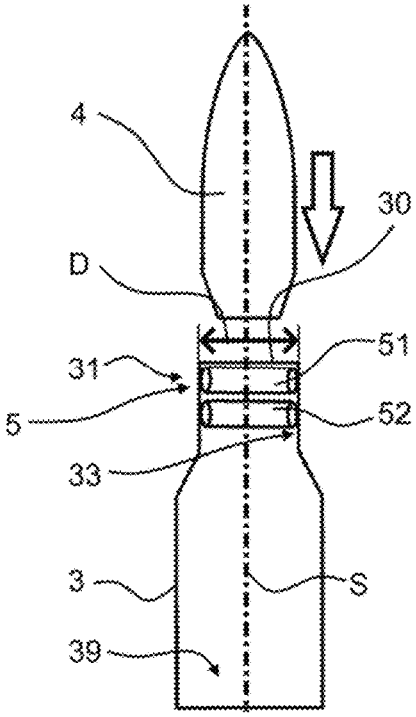

FIG. 4 a schematic sectional view of a bullet case with two annular sealing-medium-layers arranged in the neck portion and a separate projectile according to one or more exemplary embodiments of the disclosure.

The exemplary embodiments of the present disclosure will be described with reference to the accompanying drawings. Elements, features and components that are identical, functionally identical and have the same effect are—insofar as is not stated otherwise-respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

It is an object of the disclosure to provide a bullet cartridge and an associated method of manufacturing as well as a corresponding plant for manufacturing which overcome the disadvantages of the prior art, in particular ensuring low-cost and high-quality series production of bullet cartridges with sealing between the bullet case and the projectile.

Accordingly, the disclosure relates to a bullet cartridge comprising a bullet case defining a caliber diameter and a projectile inserted into the neck portion of the bullet case. In particular, the bullet cartridge is manufactured using the method described below. The bullet cartridge has an annular gap delimited by the projectile on the inside and the inner circumference of the bullet case on the outside. In the bullet cartridge according to the disclosure, an annular layer of a sealing medium formed of a sealing medium is provided between the bullet case and the projectile. The annular layer may be applied by means of microdosing (e.g., using a microdosing device or "microdoser"). Alternatively, or additionally, the annular layer comprises not more than 1 mg of sealing medium per mm of caliber diameter, in particular not more than 0.5 mg of sealing medium per mm of caliber diameter, preferably not more than 0.3 mg of sealing medium per mm of caliber diameter. It may be preferred that the bullet cartridge comprises an annular layer of sealing medium having a weight of about 2 mg. In particular, the bullet cartridge may be provided with exactly one annular layer of the sealing medium. According to an alternative embodiment, the bullet cartridge may have two annular layers of the sealing medium spaced apart in the axial direction. Preferably, the sealing medium complies with the Technical Purchase Specification TL 8010-025 paragraph 2-2.4.11 (Technical Requirements; in short: TL 0810-025) of the German Federal Office of Defense Technology and Procurement (as of 02/2021). Preferably, the sealing medium is a bitumen-containing sealant mixture, such as a bitumen-containing sealing lacquer, in particular according to TL 0810-025. The bitumen mixture can have at least one additive, preferably graphite. The at least one annular layer of the sealing medium is preferably formed in a completely circular manner around the projectile.

In a preferred embodiment of a bullet cartridge, the sealing medium of the at least one annular layer is uniformly distributed in the circumferential direction. Preferably, the sealing medium of the annular layer is almost one hundred percent uniformly distributed in the circumferential direction. In particular, the at least one annular layer has circumferential deviations of not more than 50 nL/mm annular circumferential width, in particular not more than 10 nL/mm annular circumferential width, 5 nL/mm annular circumferential width or 1 nL/mm annular circumferential width, preferably not more than 0.5 nL/mm annular circumferential width.

According to one embodiment of a bullet cartridge, the at least one annular layer has a width of at least 1 mm, in particular at least 2 mm. Alternatively or additionally, the layer has a width of not more than 10 mm, in particular not more than 6 mm. The width of the annular layer defines its extension in the axial direction or (parallel to the symmetry axis of the bullet case).

According to one embodiment of a bullet cartridge, the at least one annular layer has a thickness of at least 0,003 mm, in particular at least 0,005 mm. Alternatively or additionally, the layer has a thickness of not more than 0.04 mm, preferably not more than 0,025 mm, in particular not more than 0,015 mm. The thickness of the annular layer defines its extension in radial direction to the symmetry axis of the bullet case.

In one embodiment of the bullet cartridge, the annular layer is formed from multiple drops, in particular microdrops and/or nanodrops. Preferably, the annular layer is formed of at least 3, at least 5, or more drops. In particular, the annular layer is formed of drops, preferably microdrops and/or nanodrops. Preferably, a single droplet has a diameter or width that is substantially smaller than the width of the annular layer. In particular, a droplet is at least 10 times, preferably at least 100 times smaller than the width of the annular layer. Compared to sealing layers of conventional bullet cartridges, an annular layer formed by multiple drops can be realized with much more precise manufacturing tolerances with respect to sealing effect and material consumption.

According to one embodiment, the bullet cartridge comprises not more than one annular layer. Surprisingly, it has been shown that even with a single, thin sealing-medium-layer applied with microdosing, a reliable sealing effect can be achieved with the least amount of material.

In particular, in one embodiment of the bullet cartridge, it is provided that the sealing medium comprises 50 vol-% to 70 vol-% of a preferably bitumen-containing sealant mixture, in particular 54 vol-% to 65 vol-% of a preferably bitumen-containing sealant mixture, as well as 5 vol-% to 20 vol-% thinner, in particular 6.5 vol-% to 16.5 vol-% thinner, and 25 vol-% to 40 vol-% of graphite (D90<10 μm), in particular 28.5 vol-% to 32 vol-% graphite (D90<10 μm), or consists thereof. For example, the sealant may be provided as a mixture, for which in relation to each other, 100 mL of a preferably bitumen-containing sealant mixture, 10 mL to 30 mL thinner, and 44 mL to 52 mL of graphite are comprised. It is conceivable that one, in particular single or first, annular layer of the bullet cartridge is formed from such a graphite-containing sealant mixture. In a bullet cartridge having a second annular layer, the second layer may be formed from a sealing medium free of graphite. The sealing medium of the second layer may comprise, a preferably bitumen-containing sealant mixture and a thinner, in particular consist thereof. For example, the sealing medium of the second layer may be provided as a mixture, for which in relation to each other, 100 mL of a preferably bitumen-containing sealant mixture and 10 mL to 30 mL thinner are comprised.

A method of manufacturing a bullet cartridge is further provided, wherein a bullet case is first provided having a neck portion for receiving a projectile. The neck portion defines an inner circumference which may correspond to the caliber diameter. In the method, an annular, preferably full circumferential, layer of a sealing medium is applied to a bullet case at an inner circumference in the neck portion of the bullet case. Preferably, a bitumen-based sealing medium is used. The bitumen-based sealing medium may comprise bitumen and at least one thinner. The thinner may be selected from the group comprising ketones, esters, alcohols and hydrocarbons, in particular aromatic hydrocarbons, or a mixture thereof. The sealing medium may comprise an additive in addition to a preferably bitumen-containing sealant mixture. A suitable additive is, for example, graphite powder. Graphite powder is suitable for adjusting the slip properties of the bitumen mixture. According to the disclosure, it is provided that a predetermined amount of the applied sealing medium is provided by a microdosing process, which may be referred to as microdosing. For example, the amount of sealing medium can be provided gravimetrically or volumetrically predetermined by the microdosing. For example, the microdosing can comprise a lifting chamber with a lifting piston movably arranged therein, and the amount of sealing medium can be determined by means of the volume of the lifting chamber, the travel range of the lifting piston, and the number of dosing lifts. In particular, microdosing can be realized by a jet valve or microdosing valve (of a microdosing device or "microdoser"), such as a solenoid valve or a piezo valve.

Surprisingly, it has been shown that, contrary to the general assumption, a cost-effective and easily controllable series production of bullet cartridges with a seal made of a preferably bituminous sealing medium can be realized by using microdosing. Microdosing is known from inkjet printing. With the aid of microdosing, smallest amounts of a sealing medium can be applied in a well-dosed manner to the inner surface in the neck portion of the bullet case. This enables considerable savings to be made in terms of the minimum amount of sealing medium required, which is particularly advantageous in the series production of bullet cartridges.

According to a preferred embodiment, exactly 2 or more than 2 rings are applied as a respective full circumferential layer of the sealing medium to an inner circumference of the bullet case. In a manufacturing method comprising the application of 2 or more annular sealing-medium-layers, it may be preferred that at least 2 different rings are produced from different sealing media. For example, a first, in particular near-edge, ring may be applied a bitumen-based sealing medium with at least one additive, which may preferably comprise graphite, and a second, in particular far-edge, ring may be applied with another, in particular bitumen-based, sealing medium, preferably with a smaller amount of additive, in particular without additive and/or without graphite.

According to an alternative preferred embodiment of the method, it can be provided that only a single ring is applied as a fully circumferential annular layer of the sealing medium on the inner circumference of the bullet case. The in particular single annular sealing-medium-layer is preferably applied to the outer edge of the bullet case. By providing two annular layers of the sealing medium to be applied one after another and separately from each other in the axial direction of the cartridge case, the amount of sealing medium required can be reduced. It has been shown that this can be done for at least some types of bullet cartridges without impairing the sealing effect.

In one embodiment of a method for manufacturing a bullet cartridge, following the application of at least one annular layer of a sealing medium, a bullet is inserted into the neck portion of the bullet case. The sealing medium layer seals an annular gap between the inner circumference of the bullet case neck portion and the cylinder outer surface of the projectile inserted therein.

According to one embodiment of the method, a bullet cartridge is manufactured with a certain caliber diameter. The caliber diameter is defined according to the inner diameter of the inner circumference in the neck portion of the bullet cartridge. For forming the annular layer, a predetermined amount of not more than 1 mg of sealing medium per mm of caliber diameter is applied in relation to the caliber diameter of the bullet cartridge. In particular, not more than 0.5 mg of sealing medium is applied per mm of caliber diameter. Preferably, not more than 0.3 mg of sealing medium per mm of caliber diameter is applied. By applying a small amount of sealing medium per caliber diameter by means of microdosing, it can be ensured that the applied layer of sealing medium does not form a ring that is too wide or too thick on the inner circumference of the bullet case.

According to a further development of the method, a predetermined amount of not less than 0.01 mg of sealing medium per mm of caliber diameter is applied for forming the annular layer in relation to the caliber diameter of the bullet cartridge. In particular, not less than 0.03 mg of sealing medium per mm of caliber diameter, preferably not less than 0.05 mg of sealing medium per mm of caliber diameter, is applied.

It may be preferred that the sealing medium is applied with a layer thickness of not more than 0.1 mm, in particular not more than 0.05 mm. This can ensure that the bullet cartridge remains loadable. Alternatively, or additionally, it may be preferred that the sealing medium is applied with a layer thickness of at least 0,005 mm, preferably at least 0,007 mm. It has been shown that a reliable seal can be achieved with good reproducibility from such a layer thickness. In particular, the sealing medium can be applied with a layer thickness in the range from 0,007 to 0.02 mm, preferably in the range from 0.01 mm to 0,015 mm.

In one embodiment of a method combinable with the foregoing, a bitumen-containing sealant mixture is provided as the sealant medium. Preferably, the bitumen-containing mixture comprises bitumen and a thinner. In addition, the bitumen-containing mixture may comprise an additive, such as graphite, in particular graphite powder, for adjusting the sliding properties of the annular layer of sealing medium. The bullet cartridge can be manufactured particularly inexpensively if the sealing medium is a bitumen mixture. Preferably, the sealing medium is guided with respect to the microdosing device, for example a jet valve, in particular a piezo valve or a solenoid valve, at a temperature of at least 25° C., in particular at least 30° C., preferably at least 35° C., and/or at most 60° C., in particular at most 55° C., preferably at most 50° C., particularly preferably at most 45° C. The temperature control (e.g., by controller 75) in the microdosing can be realized, for example, by equipping the microdosing device (microdoser) 7 with a heater and/or cooler 73 for the sealing medium. Preferably, the temperature controller 75 can be used to ensure that the sealing medium, in particular the bitumen-containing mixture, is continuously kept within a predetermined temperature band during conveyance through the microdosing. For some sealing media, such as bitumen-based sealing media, it has proven advantageous to use precise temperature control to influence the material properties of the dispensed sealing medium, such as its phase composition and/or viscosity.

Alternatively, or additionally, during the method, an ambient temperature range can be set, in particular in a controlled manner, at least temporarily and/or sectionally, in particular in the spatial environment of the microdosing. For example, during the method, at least temporarily and/or sectionally, in particular in the spatial environment of the microdosing, the temperature of the bullet case and/or the temperature of a holder which receives the bullet case, can be set in a predetermined ambient temperature range. The ambient temperature range may, for example, be determined as at least 10° C., in particular at least 15° C., preferably at least 20° C., and/or at most 50° C., in particular at most 45° C., preferably at most 40° C. Setting a defined ambient temperature range can be advantageous for a temperature-sensitive sealing medium.

According to one embodiment of the process, the sealing medium, in particular in the microdosing, is adjusted to a viscosity in the range from about 5 s to 100 s, in particular 10 s to 70 s, preferably in a range from 30 s to 70 s or in a range from 10 s to 20 s. The viscosity of the sealing medium, in particular of the bitumen-containing sealing medium, can be adjusted in particular in accordance with a viscosity measurement method according to DIN 52211, preferably with an ISO-4 mm-flow cup. DIN 52211-1987-06 can be authoritative. To adjust the viscosity, on the one hand, the composition of the sealing medium can be adjusted from a sealant, for example bitumen, and other components, for example thinner and/or additive. Additionally, or alternatively, in combination with the temperature control operated above, the viscosity can sometimes be influenced.

According to a further development of the method, the sealing medium is dispensed from the microdosing in mist form. In particular, the microdosing device (microdoser) 7 can be used to dispense mist in the form of nanodrops, preferably nanodrops with a volume in the nanolitre range, in particular with a nanodrop-volume in the range 1 nL to 500 nL. In particular, for dispensing the sealing medium in mist form, the viscosity of the sealing medium in the microdosing is set to at most 30 s, in particular at most 25 s, preferably at most 20 s. Fogging of the sealing medium makes it possible to produce a particularly thin annular sealing-medium-layer and thus save a particularly large amount of bitumen material.

In an alternative further development of the process, the sealing medium is dispensed from the microdosing in droplet form. Dispensing the droplet-shaped sealing medium from the microdosing preferably occurs by a droplet dispensing from the microdosing device (microdoser) 7, which is implemented, for example, as a jet valve, moving away from the microdosing device (microdoser) 7 and, after the respective droplet has been detached from the microdosing device (microdoser) 7, hitting the bullet case. With the aid of microdosing device (microdoser) 7, precisely defined sealing medium drops are secreted, which, after being applied to the inner circumference, converge with each other to form a full circumferential, annular layer of sealing medium. When the sealing medium is dispensed in droplet form from the microdosing, the viscosity is preferably adjusted in the microdosing to at least 10 s, in particular at least 15 s, preferably at least 30 s.

According to a further development of the manufacturing method, in which the sealing medium is dispensed from the microdosing droplet, for forming the annular layer for a single bullet case, at least one droplet is dispensed. Preferably, multiple drops are dispensed. Microdosing can be used to dispense in particular drops in the form of microdrops, preferably microdrops with a volume in the microliter range, in particular with a microdroplet volume in the range 10 nL to 50 μL, in particular 100 nL to 5 μL. Five successively dispensed drops, in particular at least partially overlapping one another, preferably have a cumulative standard deviation of not more than ±10%, in particular not more than ±5%, preferably not more than 4%, relative to the dispensed volume. In particular, the bullet cartridge is manufactured with a certain caliber diameter and 1 to 5 drops per mm caliber diameter are dispensed for forming the annular layer in relation to the caliber diameter of the bullet cartridge. Alternatively, or additionally, in one embodiment, an annular layer having a width of at least 1 mm, in particular at least 2 mm, and/or not more than 10 mm, in particular not more than 6 mm, and/or having a thickness of at least 0,003 mm, in particular at least 0,005 mm, and/or not more than 0,04, preferably not more than 0,025 mm, in particular not more than 0,015 mm, may be formed. It has been shown that even with thin and narrow rings of, for example, not more than one drop per mm of caliber diameter, a sufficient sealing effect can be achieved by the ring- or band-shaped layer on the bullet case produced with the aid of the sealing medium. In some cases, the sealing effect may be improved by using more than one drop per mm caliber diameter.

According to a further development of the method, which can be combined with the previous one, the drops are dispensed at a rate in the range from 100 Hz to 3000 Hz, in particular in the range from 250 Hz to 2000 Hz, preferably in the range from 300 Hz to 1000 Hz. The pressure medium is provided to the microdosing device (microdoser) 7 at a pressure of preferably about 1 bar. It is conceivable that a microdosing device (microdoser) 7 is implemented as a pump valve, for example a piezo valve, and the droplet-dispensing-rate is composed of a suction time and a lifting time. Preferably, the suction time corresponds approximately to the lifting time. The suction time can be in the range 150 μs to 400 μs or 800 μs. Alternatively, or additionally, the lifting time may be in the range 150 μs to 400 μs or 800 μs. Alternatively, the microdosing device (microdoser) 7 can be implemented as an, in particular a pressurized, opening valve, for example as a solenoid valve, and the droplet-dispensing-rate can be composed of a valve opening time and a valve closing time. It may be preferred that the valve opening time is at most as long as or shorter than the valve closing time. The valve opening time can be in the range of 350 μs to 1000 μs. In the microdosing device (microdoser) 7, in particular in a pressurized opening valve, the sealing medium can be provided at a pressure in the range from 1 bar to 10 bar, preferably 2 bar to 5 bar.

In one embodiment of the method, which can be combined with the previous ones, it is provided that at least the neck portion of the bullet case is radially widened, in particular in the region of an edge of the confluence, which may be referred to as the case mouth edge, before insertion of the projectile. The neck portion, in particular the confluence, of the bullet case can be widened, in particular after the sealing medium has been applied. In particular, the neck portion is widened by a few μm, in particular less than 30

μm, preferably less than 20 μm, particularly preferably less than 10 μm. By pre-expansion of the case mouth, a scratch deformation of the neck portion by the projectile can be counter-acted, which could impair the sealing effect.

In one embodiment of a manufacturing method that can be combined with the previous ones, the sealing medium is dispensed from the microdosing device (microdoser) 7 through a nozzle 71. Preferably, the nozzle 71 for dispensing the sealing medium is held at an inclined angle, in particular orthogonally, to the inner circumference. This can minimize the risk of a drop ricochet (statellite). It may be preferred to keep the nozzle aligned in a direction that deviates from a direction of movement of an actuator, such as a piezostack or a magnetic armature, of the microdosing device (microdoser) 7. Alternatively, or additionally, it may be preferred that the nozzle is held at a predetermined distance from the inner circumference. The nozzle may be held at a distance of at least 0.5 mm, in particular at least 1 mm, and/or at a distance of not more than 20 mm, in particular not more than 10 mm, preferably not more than 5 mm or not more than 7 mm. The distance between the nozzle and the inner circumference can be determined in particular on the basis of the path to be covered from the nozzle to the inner circumference through the, in particular in droplet- or sprayshaped, sealing medium. It has been shown that with such an arrangement of the nozzle in relation to the inner circumference, a homogeneous, annular sealing-medium-layer can be produced in the neck portion of the bullet case.

In one embodiment of the method, a movement for inserting the nozzle into the neck portion of the bullet case is performed before dispensing the sealing medium. In particular, a linear movement is performed, wherein the linear movement is preferably parallel or coaxial to the symmetry axis of the bullet case. Preferably, the nozzle is moved into the bullet case, which is in particular held stationary, in order to insert the nozzle into the bullet case. Alternatively, or additionally, the bullet case can be moved relative to the, in particular stationary, nozzle, wherein in particular the bullet case is slipped over the nozzle when the valve is stationary.

In particular, the process time for coating a bullet case with at least one annular layer of sealing medium can be set to a rate in the range from 0.1 Hz to 10 Hz, in particular in the range from 0.2 Hz to 5 Hz, preferably in the range from 0.3 Hz to 3 Hz. For example, 3 bullet casings can be internally coated per second.

In a further development of the manufacturing method, a nozzle is used which has an initial diameter in the range from 0.05 mm to 0.5 mm, in particular in the range from 0.1 mm to 3 mm, preferably with an initial diameter of about 0.15 mm.

According to one embodiment of the method, it may be provided that the bullet case is rotated in relation to the microdosing device (microdoser) 7, in particular the nozzle 71, about a symmetry axis of the bullet case 3. Preferably, the relative rotation of the bullet case with respect to the microdosing device (microdoser) 7, in particular the nozzle 71, occurs during the dispensing of the sealing medium from the microdosing device (microdoser) 7. In particular, the relative rotation of the bullet case with respect to the microdosing device (microdoser) 7 may occur during the dispensing of the at least one droplet or spray mist. It may be preferred that the bullet case may be continuously rotated while the sealing medium for forming the annular layer is applied. Preferably, the relative position of the bullet case with respect to the microdosage device (microdoser) 7 occurs by holding the microdosage on a stationary frame while the bullet case is held by a support that is movable with respect to the frame.

In particular, in one embodiment of the method, it is provided that the sealing medium is formed as a mixture comprising or consisting of 50 vol-% to 70 vol-% of a preferably bitumen-containing sealant mixture, such as a sealing lacquer, in particular 54 vol-% to 65 vol-% of a preferably bitumen-containing sealant mixture, as well as 5 vol-% to 20 vol-% thinner, in particular 6.5 vol-% to 16.5 vol-% thinner, and 25 vol-% to 40 vol-% graphite (D90<10 μm), particularly 28.5 vol-% to 32 vol-% graphite (D90<10 μm). For example, the sealing medium may be provided as a mixture, for which in relation to each other, 100 mL of sealant mixture, 10 mL to 30 mL thinner, and 44 mL to 52 mL of graphite are comprised. It is conceivable that one, in particular single or first, annular layer of the bullet cartridge is formed from such a graphite-containing sealant mixture. When manufacturing a bullet cartridge with a second annular layer, the second layer may be formed from a sealing medium free of graphite. The sealing medium of the second layer may be formed from a mixture comprising or consisting of a preferably bitumen-containing sealant mixture and a thinner. For example, the sealing medium of the second layer may be provided as a mixture, for which in relation to each other, 100 mL of preferably bitumen-containing sealant mixture and 10 mL to 30 mL thinner are comprised.

According to the disclosure, there is further provided a plant (e.g., apparatus) for manufacturing bullet cartridges. The plant for manufacturing bullet cartridges comprises a bearing (holder 80) for holding a bullet case 3 having a neck portion 31 for receiving a projectile defining an inner circumference. In accordance with the disclosure, the plant comprises a microdosing device 7 (also referred to as microdoser) for providing a predetermined amount of a sealing medium for application to the inner circumference. Alternatively, or additionally, the plant is adapted and arranged to perform a method as described above. The plant may include a plurality of microdosing devices (microdosers) 7 with which sealing medium may be simultaneously applied to a plurality of different bullet casings. In the plant of the disclosure, the ratio of the number of microdosages to bullet cartridges within the plant may be at least 1:1. The ratio of microdosing devices (microdosers) 7 and bullet cartridges 3 within the plant may be greater than 1:1.

In one embodiment, the plant comprises a temperature control (e.g., controller 75) for guiding the sealing medium, in particular in the microdosing, preferably with a temperature of at least 25° C. and/or at most 60° C. The temperature control (controller) 75 comprises at least one heater and/or cooler 73 and optionally a temperature sensor 74. The controller 75 (and/or) one or more components therein may include processing circuitry configured to perform one or more functions of the controller 75 or respective component (s) therein.

According to another embodiment, the plant has one, in particular exactly one, nozzle fluidically connected to the microdosing device (microdoser) 7 with an outlet diameter in the range of 0.05 mm to 0.5 mm, in particular in the range of 0.1 mm to 3 mm, for dispensing the sealing medium. Such a nozzle, in conjunction with a microdosing, in particular a jet valve or microdosing valve, such as a solenoid valve or a piezo valve, has proven to be particularly suitable for providing sealing, fully circumferential, annular layers of the sealing medium onto the bullet case.

According to a further development, the nozzle 71 and the bearing 80 are matched to one another in such a way that the nozzle is aligned orthogonally to the inner circumference when the sealing medium is dispensed. In this way, a particularly clean layer of sealing medium can be applied.

According to another further development, the nozzle 71 and the bearing 80 are matched to one another in such a way that the nozzle is kept at a predetermined distance of at least 0.5 mm, in particular at least 1 mm, and/or not more than 20 mm, in particular not more than 10 mm, preferably not more than 5 mm, from the inner circumference when dispensing the sealing medium. In this distance range, clean application can be ensured without the fear, even with a highly viscous sealing medium, that the nozzle will smear with the sealing medium along the inner circumference.

In a further development of the plant that can be combined with the previous ones, the nozzle 71 and the bearing (holder) 80 for moving the nozzle relative to the inner circumference, in particular for inserting the nozzle into the neck portion of the bullet case, are movable relative to each other, in particular linearly. The linear mobility can be useful for applying multiple annular layers side-by-side to the inner circumference.

According to one embodiment of the plant, the bearing (holder) 80 is adapted to the microdosing device (microdoser) 7 and/or the nozzle 71 in such a way that the bullet case 3 can be rotated about a symmetry axis S of the bullet case, preferably continuously. By rotating the inner circumference around the output opening of the microdosing, in particular of the nozzle 71, a reliable full circumferential seal can be realized.

In one embodiment, the plant comprises a conveyor 81 for feeding and/or discharging at least one bullet case per second, in particular at least two bullet cases per second, preferably at least three bullet cases per second, to or from the microdosing. A conveyor 81 can guide bullet casings, in particular in the or into the bearing, to the microdosing so that the sealing medium can subsequently be applied. The same or a second conveyor can convey bullet casings, in particular in the or out of the bearing, away from the microdosing after at least one annular layer of sealing medium has been applied to the inner circumference.

A bullet cartridge is generally designated by the reference sign 1. The bullet cartridge 1 comprises as essential components a bullet case 3, a projectile 4 and a sealing medium 5 provided between the projectile 4 and the bullet case 3.

FIG. 1 shows a schematic cross-sectional view of a bullet cartridge 1. The sealing medium 5 creates a seal between the projectile 4 and the case 3. The bullet case 3 is a rotational body with a symmetry axis S. The bullet cartridge 1 has a certain caliber diameter D, which can be determined on the basis of the inner diameter at the inner circumference 33 in the neck portion 31 of the case 3. Typical caliber diameters D are, for example, 5.56 mm, 7.62 mm or 8.6 mm. The neck portion 31 designates the section of the case 3 into which the projectile 4 is inserted to form the bullet cartridge 1. In the case of the bullet case 3 shown in FIGS. 1 and 4, the neck portion 31 has a narrower diameter than a region 39, located behind it with respect to the confluence 30 of the case 3, for receiving the propellant charge.

Two annular layers 51, 52 of the sealing medium are applied to the inner circumference 33 of the case 3 in its neck portion 31. A first layer 51, arranged closer to the free edge of the case 3, contains a bitumen-containing sealing lacquer mixed with an additive as sealing medium 5. The sealing medium for forming the first layer 51 may, for example, comprise 42 wt.-% of a bitumen-containing sealing lacquer, 42 wt.-% of thinner and 16 wt.-% of graphite. An optional second layer 52, arranged deeper in the case, contains a bitumen-containing sealing lacquer without additive. The second layer 52 contains 66 wt % of a bituminous sealing lacquer and 34 wt % of thinner. The same or a different mixture may be used for an embodiment with only one annular layer 51. Alternatively, in particular for an embodiment with only one annular layer 51, the sealing medium may comprise 50 vol-% to 70 vol-% of a bitumen-containing sealing lacquer, especially 54 vol-% to 65 vol-% of a bitumen-containing sealing lacquer, and 5 vol-% to 20 vol-% thinner, in particular 6.5 vol-% to 16.5 vol-% thinner, and 25 vol-% to 40 vol-% of graphite (D90<10 μm), in particular 28.5 vol-% to 32 vol-% graphite (D90<10 μm). The width of the first and/or second layer 51, 52 parallel to the direction of the symmetry axis S of the bullet case 3 is in the range of 0.5 mm to 6 mm each, in particular in the range of 1 mm to 3 mm each. The thickness of the first and/or second layer 51, 52 radial to the direction of the symmetry axis S of the bullet case 3 is in the range of 0.003 mm to 0.04 mm, in particular in the range of 0.005 mm to 0.015 mm. The distance between two layers 51, 52 can be less than 2 mm, in particular less than 1.5 mm.

FIGS. 2*a* and 2*b* schematically show a first method for applying annular layers 51 and 52 of sealing medium 5 to the inner circumference 33 of the bullet case 3. The sealing medium 5 is applied to the inner circumference 33 of the bullet case 3 in the neck portion 31 of the bullet case 3 by means of microdosing device (microdoser) 7. With the aid of the microdosing device (microdoser) 7, the sealing medium 5 is applied particularly uniformly to the inner circumference. The microdosing device (microdoser) 7 is held completely outside the bullet case 3, in front of its confluence 30. The bullet case 3 is rotated about its symmetry axis S in relation to the microdosing device (microdoser) 7. In an exemplary embodiment, the microdoser 7 includes processing circuitry that is configured to perform one or more functions of the microdoser 7.

In the embodiment shown in FIG. 2*a*, the sealing medium 5 is applied to the inner circumference 33 in the form of drops 55 from the microdosing device (microdoser) 7. By means of microdosing device (microdoser) 7, multiple defined individual spots of sealing medium 5 are applied along the inner circumference 33 of the case 3, which together form a circumferential and homogeneous coating ring. In relation to the caliber diameter D of the bullet case 3, the microdosing device (microdoser) 7 dispenses one to five drops, which may also be referred to as shots, per mm of caliber diameter D. For example, with a 5.56 mm caliber diameter, 6 to 28 shots can be dispensed. With a 7.62 mm caliber diameter, 8 to 38 shots can be dispensed. With an 8.6 mm caliber diameter, 9 to 42 shots can be fired.

The microdosing device (microdoser) 7 has a nozzle 71 with an opening diameter in the range from 0.1 mm to 0.3 mm at its discharge end directed towards the bullet case 3. The nozzle 71 is adapted and arranged to dispense the sealing medium 5 in a certain firing direction or dispensing direction A. The dispensing direction A is oriented at an inclined angle with respect to the symmetry axis S. The dispensing direction A may cross the symmetry axis S. The inclined angle between the dispensing direction A and the symmetry axis S can be in the range of 30° to 90°, for example. Preferably, the oblique angle is at least 45°, in particular at least 60°. The nozzle 71 of the microdosing device (microdoser) 7 is kept at a distance from the inner circumference 33 of the bullet case 3 in the dispensing direction A. The individual drops 55 of the sealing medium 5 are then not simultaneously in contact with both the nozzle 71 and the inner circumference 33.

As shown in FIG. 2*b*, the annular sealing-medium-layer 51, which is closer to the confluence 30, is produced first, followed by the second layer 52 of sealing medium 5, which is more distant with respect to the confluence 30. Alternatively, in reverse order, the second layer 52 can be produced first and then the first layer 51.

For example, a bitumen-containing mixture can be used as the sealing medium 5. The sealing medium 5 may comprise a bitumen-containing sealant mixture, such as a sealing lacquer, and a thinner, and optionally an additive, such as graphite. For application by means of microdosing 7, the viscosity of the bitumen-containing mixture can be adjusted in a range from 10 s to 70 s. The viscosity of the sealing medium 5 can be determined by the viscosity measurement method according to DIN 52211 using a 4 mm-ISO-dip-flow cup.

It has been found to be advantageous if the microdosing device (microdoser) 7 is provided with a heater and/or cooler 73 for controlled adjustment (e.g., by the controller 75) of the temperature of the sealing medium 5. With a heater and/or cooler 73, the temperature of the sealing medium 5, while it is conveyed (e.g., by conveyor 81 and/or holder 80) through the microdosing device (microdoser) 7, can be guided in a temperature range between, for example, 30° C. and 55° C. The heater and/or cooler 73 may be adapted and arranged to impose a controlled temperature on the complete microdosing device (microdoser) 7. Alternatively, the heater and/or cooler 73 can be adapted and arranged to regulate the temperature of different portions of the microdosing device (microdoser) 7 independently of one another.

For example, a microdosing valve in the form of a solenoid valve from Fritz-Gyger AG can be used as microdosing device (microdoser) 7, in particular valve type: SMLD 300G (sub-micro liquid dispenser). The microdosing valve can, for example, be an electromagnetically actuated, so-called solenoid valve. The sealing medium 5 flows directly through the microdosing valve. In the de-energized state, the microdosing valve is closed. A closing spring of the microdosing valve acts on a mobile armature with a valve ball. When the valve coil is energized, the mobile armature with the valve ball is magnetically attracted by the magnetic field of a stationary armature, so that the microvalve opens and the sealing medium, which is under a pressure of, for example, 1 to 5 bar dispenses from the valve nozzle 71. The microdosing valve comprises a built-in heater 73 for adjusting the temperature of the sealing medium 5. The microdosing valve preferably comprises a hard-sealing valve, which is preferably adapted and arranged to ensure an opening lift of a few hundredths of a mm in a precisely reproducible manner. The microdosing valve can be arranged for a cycle rate of up to 4000 Hz. Hard materials, such as sapphire and/or ruby, may be provided for the valve seat and/or the valve ball. The microdosing valve is preferably adapted and arranged to reproducibly dispense individual shots or drops in the nanoliter range.

Alternatively, a microdosing valve in the form of a piezo valve from the company VERMES Microdispensing, in particular valve type MDV 3280, can be used as microdosing device (microdoser) 7. The microdosing valve is preferably adapted and arranged for reproducibly dispensing individual shots or drops in the nanoliter range. The piezo valve can be adapted and arranged to be placed under voltage by a control unit (controller) 75 for dosage of a sealing medium 5. The voltage pulses applied to the piezo valve by the control unit 75 open and/or close the piezo valve. The piezo valve may comprise a plunger for closing the nozzle 71. The plunger may be connected to a piezostack of the piezo valve by means of a lever device. By moving the piezo stack up and down, drops or shots can be precisely dispensed at a frequency of several 100 Hz.

FIGS. 3*a* and 3*b* show a second method for producing layers 51, 52 from sealing medium 5 on the inner circumference 33 of a bullet case 3. The method differs substantially only from that previously described in that the nozzle 71 of the microdosing device (microdoser) 7 is oriented in a substantially orthogonal dispensing direction A with respect to the inner circumference 33. The nozzle 71 is inserted into the bullet case 3 through the confluence 30 for application of the sealing medium 5. For this purpose, the nozzle 71 can be moved linearly into the bullet case parallel to the direction of the symmetry axis S. The nozzle 71 has a curvature 72 in the area just before its dispensing opening, which defines the dispensing direction A. After the sealing medium has been applied, the nozzle 71 is removed again from the neck portion 31 of the bullet case 3, for example, with a reverse movement.

As shown in FIG. 3*b*, the annular sealing medium layer 52, which is further away from the confluence 30, is produced first, followed by the sealing medium layer 51, which is closer to the confluence 30.

In the two methods illustrated in FIGS. 2*a* and 3*a*, respectively, the sealing medium 5 may be dispensed in the form of drops 55 or in the form of a spray mist 57. In order to dispense a spray mist 57, it may be preferred to set the viscosity of the sealing medium 5 to not more than 20 s. This allows a spray mist 57 to be applied to the case 3 from the microdosing device (microdoser) 7. The spray mist 57 can be used to apply a particularly thin sealing medium layer 51, 52.

After the application of the single layer or, optionally, the two layers 51 as well as 52, as indicated in FIG. 3, the projectile 4 is inserted (as shown in FIG. 4) into the neck portion 31 of the case 3 to form the bullet cartridge 1 shown in FIG. 1.

The features disclosed in the foregoing description, figures, and claims may be significant to the various embodiments of the disclosure both individually and in any combination.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

The various components described herein may be referred to as "modules," "units," or "devices." Such components may be implemented via any suitable combination of hardware and/or software components as applicable and/or known to achieve their intended respective functionality. This may include mechanical and/or electrical components, processors, processing circuitry, or other suitable hardware components, in addition to or instead of those discussed herein. Such components may be configured to operate independently, or configured to execute instructions or computer programs that are stored on a suitable computer-readable medium. Regardless of the particular implementation, such modules, units, or devices, as applicable and relevant, may alternatively be referred to herein as "circuitry," "controllers," "processors," or "processing circuitry," or alternatively as noted herein.

For the purposes of this discussion, the term "processing circuitry" shall be understood to be circuit(s) or processor(s), or a combination thereof. A circuit includes an analog circuit, a digital circuit, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

LIST OF REFERENCE SIGNS

1 bullet cartridge
3 bullet case
4 projectile
5 sealing medium
7 microdosing device (microdoser)
30 confluence
31 neck portion
33 inner circumference
39 range
51, 52 annular layer
55, 57 drop or spray mist
71 Nozzle
72 Curvature
73 Heater and/or cooler
74 sensor
75 controller
80 holder (bearing)
81 conveyor
A dispensing direction
D caliber diameter
S symmetry axis

The invention claimed is:

1. A bullet cartridge comprising:

a bullet case defining a caliber diameter and having a neck portion;

a projectile configured to be inserted into the neck portion of the bullet case; and at least one annular layer of a sealing medium formed from a sealing medium between the bullet case and the projectile and applied at a temperature of at least 25° C. and at most 60° C., wherein:

the at least one annular layer is at least one microdosed annular layer, and/or the at least one annular layer comprises not more than 0.5 mg of sealing medium per mm of caliber diameter.

2. The bullet cartridge according to claim 1, wherein the sealing medium of the at least one annular layer is uniformly distributed in a circumferential direction.

3. The bullet cartridge according to claim 1, wherein the at least one annular layer has: a width of at least 1 mm, and/or a thickness of at least 0.003 mm.

4. The bullet cartridge according to claim 1, wherein the at least one annular layer comprises multiple drops of the sealing medium.

5. The bullet cartridge according to claim 1, wherein the bullet cartridge comprises only a single annular layer of the sealing medium.

6. The bullet cartridge according to claim 1, wherein the sealing medium comprises 50 vol-% to 70 vol-% of a sealant mixture containing bitumen, 5 vol-% to 20 vol-% of a thinner, and 25 vol-% to 40 vol-% of graphite.

7. A method of manufacturing a bullet cartridge, comprising:

providing a bullet case having a neck portion configured to receive a projectile, the neck portion defining an inner circumference, providing a bitumen-containing sealant mixture as a sealing medium, and applying, by microdosing at a temperature of at least 25° C. and at most 60° C., an annular layer of the sealing medium to the bullet case at an inner circumference in the neck portion of the bullet case.

8. The method according to claim 7, wherein the bullet cartridge is manufactured with a caliber diameter, and, for forming the annular layer with respect to the caliber diameter of the bullet cartridge, the method comprises:

applying a predetermined amount of not more than 1 mg of the sealing medium per mm of caliber diameter; and/or applying a predetermined amount of not less than 0.01 mg of the sealing medium per mm of caliber diameter.

9. The method according to claim 7, wherein:

the microdosed sealing medium is adjusted to a viscosity of 5 s to 100 s, according to DIN 53211 using an ISO-4 mm-dip-flow cup; and/or the sealing medium is dispensed by the microdosing in: (a) mist form, the viscosity of the sealing medium by the microdosing being at most 30 s according to DIN 53211 using an ISO-4 mm-dip-flow cup, or (b) droplet form, the viscosity of the sealing medium being at least 10 s according to DIN 53211 using an ISO-4 mm-dip-flow cup.

10. The method according to claim 7, wherein applying the annular layer comprises dispensing the sealing medium, by the microdosing, in at least one drop, and wherein:

the bullet cartridge is produced with a caliber diameter and, for forming the annular layer with respect to the caliber diameter of the projectile cartridge, the method comprises: dispensing 1 to 5 drops per mm of caliber diameter, and/or the annular layer is formed with: (a) a width of at least 1 mm and/or not more than 10 mm, in particular not more than 6 mm, and/or (b) a thickness of at least 0.003 mm and/or not more than 0.025 mm; and/or the drops are dispensed at a rate of 100 Hz to 3000 Hz.

11. The method according to claim 7, wherein:

the neck portion of the bullet case is radially widened before insertion of the projectile; and/or the sealing medium is dispensed through a nozzle of a microdoser, the nozzle being positioned: orthogonally to the inner circumference, and/or at a predetermined distance of at least 0.5 mm and/or not more than 20 mm; and/or the sealing medium is dispensed through the nozzle of the microdoser, the method comprising moving, before the sealing medium is dispensed, the microdoser to insert the nozzle into the neck portion of the bullet case; and/or the sealing medium is dispensed through the nozzle of the microdoser, the nozzle having an initial diameter of 0.05 mm to 0.5 mm; and/or the method comprises rotating the bullet case in relation to the microdoser configured to dispense the sealing medium, the rotation of the bullet case being about an axis of symmetry of the bullet case; and/or the sealing medium comprises 50 vol-% to 70 vol-% of a sealant mixture, 6.5 vol-% to 16.5 vol-% of a thinner, and 25 vol-% to 40 vol-% of graphite.

12. An apparatus for manufacturing bullet cartridges, comprising:

a holder configured to hold a bullet case having a neck portion configured to receive a projectile and defining an inner circumference;

at least one heater and/or cooler;

a temperature controller configured to control the at least one heater and/or cooler to provide a sealing medium at a temperature of at least 25° C. and at most 60° C.; and a microdoser configured to provide a predetermined amount of the sealing medium and apply the predetermined amount of the sealing medium to the inner circumference of the neck portion.

13. The apparatus according to claim 12, further comprising a nozzle fluidically connected to the microdoser and configured to dispense the sealing medium, the nozzle having an outlet diameter of 0.05 mm to 0.5 mm.

14. The apparatus according to claim 13, wherein the nozzle and the holder are matched to one another such that the nozzle is aligned orthogonally to the inner circumference when the sealing medium is dispensed.

15. The apparatus according to claim 13, wherein the nozzle and the holder are matched to one another such that the nozzle is kept at a predetermined distance of at least 0.5 mm and/or not more than 20 mm from the inner circumference when the sealing medium is dispensed.

16. The apparatus according to claim 13, wherein the holder is configured to move the bullet case and the nozzle relative to each other such that the nozzle is inserted into the neck portion of the bullet case.

17. The apparatus according to claim 12, wherein the holder is matched to the microdoser and/or the nozzle such that the bullet case is rotatable about an axis of symmetry of the bullet case.

18. The apparatus according to claim 12, further comprising a conveyor configured to feed and/or discharge at least one bullet case per second to and from the microdoser.

* * * * *